United States Patent [19]

von Laar et al.

[11] Patent Number: 4,534,294

[45] Date of Patent: Aug. 13, 1985

[54] FIN-STABILIZED PROJECTILE WITH PROPELLANT CAGE

[75] Inventors: Klaus von Laar, Lauf/Pegnitz; Werner Heberlein, Nuremberg; Josef Burda, Straubing, all of Fed. Rep. of Germany

[73] Assignee: Diehl GmbH & Co., Nuremberg, Fed. Rep. of Germany

[21] Appl. No.: 590,213

[22] Filed: Mar. 16, 1984

[30] Foreign Application Priority Data

Mar. 17, 1983 [DE] Fed. Rep. of Germany ..... 3309533

[51] Int. Cl.[3] ..... F42B 13/16

[52] U.S. Cl. ..... 102/520; 244/33

[58] Field of Search ..... 102/520–523, 102/372, 373, 384, 385; 244/3.24–3.3

[56] References Cited

U.S. PATENT DOCUMENTS

| | | | |
|---|---|---|---|
| 3,662,686 | 5/1972 | Baldini | 102/523 |
| 3,677,131 | 7/1972 | Nee | 244/3.28 |
| 3,790,104 | 2/1974 | Jones | 244/3.22 |
| 4,215,632 | 8/1980 | Sie | 102/521 |

FOREIGN PATENT DOCUMENTS

| | | | |
|---|---|---|---|
| 1090057 | 3/1955 | France | 102/520 |

*Primary Examiner*—Harold Tudor

*Attorney, Agent, or Firm*—Scully, Scott, Murphy & Presser

[57] ABSTRACT

A fin-stabilized projectile which includes a propellant cage encompassing the projectile body, and with the cage consisting of a plurality of segments retained together through suitable fastening media, and which incorporates, at its leading end, an annular recess extending beyond the overall diameter of the propellant cage, through which there is initiated the spreading apart of the segments subsequent to the exit of the projectile from the weapon barrel.

3 Claims, 2 Drawing Figures

FIN-STABILIZED PROJECTILE WITH PROPELLANT CAGE

BACKGROUND OF THE INVENTION

1. Field of the Invention

The present invention relates to a fin-stabilized projectile which includes a propellant cage encompassing the projectile body, and with the cage consisting of a plurality of segments retained together through suitable fastening media, and which incorporates, at its leading end, an annular recess extending beyond the overall diameter of the propellant cage, through which there is initiated the spreading apart of the segments subsequent to the exit of the projectile from the weapon barrel.

2. Discussion of the Prior Art

By means of the disclosure of German Published Patent Application No. 17 03 517 there has become known a fin-stabilized subcaliber projectile incorporating the above-mentioned features in which the propellant cage encompasses the projectile body only in the middle region of the latter. The closure of the propellant cage is formed through the intermediary of a sealing disc. After exiting from the weapon barrel, the propellant cage with its segments will spread apart as a result of the excess of superpressure which is formed in the recess at the leading end, and drops away from the projectile. The rigid guide mechanism which is located at the rear or trailing end projects outwardly of propellant cage in a predetermined length. As shown, trailing end guide mechanisms are more effective when they project beyond the caliber of the projectile since they are extensively located within the undisturbed airflow. In order to achieve this, there are employed multiple hinged guide mechanisms whose fins will swing outwardly, after leaving the weapon barrel, to an oversized-caliber width.

SUMMARY OF THE INVENTION

Accordingly, it is an object of the present invention to provide a projectile of the above-mentioned type incorporating a hinged guide mechanism which can be produced with the use of simple technological means and whose fins are, on the one hand, positioned against the projectile within the weapon barrel and, on the other hand, will swing open rapidly and uniformly after exiting from the weapon barrel and subsequent to the separation of the propellant cage.

The foregoing object is inventively achieved in that the propellant cage in the tailing end region of the projectile body will fix in position the fins of the guide mechanism which are retracted at the trailing end of the guide mechanism support by means of pivot elements, by partially extending thereover. Hereby, the number of the propellant cage segments can be equal to the number of the fins of the guide mechanism, or can be a multiple integer thereof, so that at least one fin will, respectively, project into respectively one propellant cage segment. Due to these simple measures, the fins of the retractable guide mechanism lie securely close against the guide mechanism support during transport as well as during loading and passage through the barrel, and do not project beyond the outer diameter of the propellant cage. The number of the fins, corresponding to the propellant cage segments, supports the operational capability during the discarding of the segments subsequent to exiting from the weapon barrel. In order to effectively assist in the separation of the propellant cage from the projectile body, pursuant to a further feature of the invention, the fins of the hinged guide mechanism, in the covered region of the propellant cage, are provided with exterior edges which extend in parallel with the longitudinal axis of the projectile, and which extend flat-conically in conformance with the covered propellant cage segments and reach their greatest expansion towards the end of the propellant cage segments.

In the retracted condition, the leading edges of the fins of the hinged guide mechanism can be inclined at an acute angle relative to the longitudinal axis of the projectile. Thereby, the atmospheric superpressure can engage below the edges of the fins and thus cause the latter to swing outwardly. The opening movement of the fins in cooperation with the flat-conical exterior edges will also raise away the propellant cage uniformly and rapidly at the trailing end portion of the projectile.

Thus, in general, during the passage of the inventive projectile through the weapon barrel and during the handling of the shell, the fins of the hinged guide mechanism are securely fixed in their retracted position by means of the propellant cage segments. When, subsequent to the separation of the guide bands, there commences the separation of the propellant cage segments from the projectile body, then this is supported by the opening force of the guide mechanism fins as a result of the inventive features.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
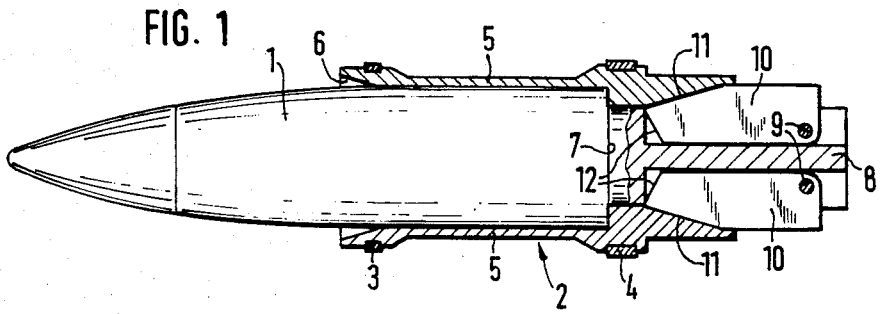
FIG. 1 illustrates a longitudinal sectional view through the fin-stabilized projectile with a propellant cage in its condition prior to firing.
Figure 2:
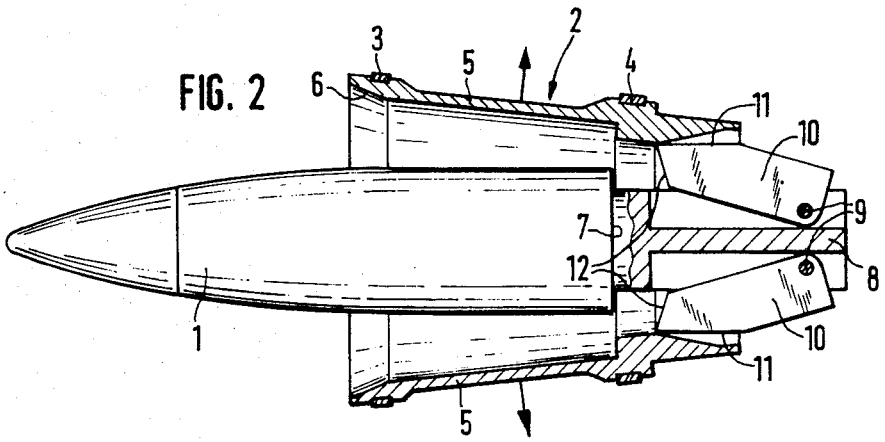
FIG. 2 illustrates the fin-stabilized projectile pursuant to FIG. 1 immediately after exiting from the weapon barrel.

The projectile 1 is closely encompassed by a propellant cage 2 which consists of at least two, and preferably three or more segments 5, as long as the projectile 1 is in its condition prior to firing. The segments 5 of the propellant cage 2 are retained together by means of guide bands 3 and 4. At its leading end, the propellant cage is provided with a recess 6 which extends beyond the caliber diameter. At the base 7 of the projectile body, there is attached the guide mechanism support 8 extending coaxially with the longitudinal axis of the projectile, at whose trailing end region there are arranged pivot elements 9, about which there can be swung the fins 10 of the hinged guide mechanism. The propellant cage 2 encompasses the guide mechanism fins 10 and fixes these in their retracted position. The exterior edges 11 of the fins are constructed flat-conically in the region which is covered by the segments 5, and reach their greatest expansion towards the end of the segments 5. Furthermore, the leading end edges 12 of the fins are inclined or sloped at an acute angle relative to the longitudinal axis of the projectile.

When the projectile 2 exits from the weapon barrel, a static pressure is generated at the annular recess 6 of the propellant cage 2 which, subsequent to the separation of the guide bands 3 and 4 will cause the propellant cage segments 5 to be raised away from the projectile body. Concurrently, a static pressure is generated along the edges 12 of the fins 10 which will swing open the fins about the pivot elements 9. The flat-conical edges 11 of the fins 10 pivot outwardly and thereby support the separation of the propellant cage segments 5. After the complete separation of the propellant cage, the fins 10 of the guide mechanism swing completely open and impart the desired flight stabilization to the projectile, whereby the fins 10 now project outwardly beyond the caliber of the projectile.

We claim:

1. In a fin-stabilized projectile including a propellant cage encompassing the body of said projectile, said propellant cage consisting of a plurality of segments; means for retaining said segments together; and an annular recess at the leading end of said cage extending along the outer diameter of the propellant cage adapted to initiate the spreading apart of segments subsequent to said projectile exiting from a weapon barrel, and a guide mechanism including pivotable fins on said projectile; the improvement comprising guide mechanism support means fastened at the trailing end of the projectile body, pivot elements for restraining in a retracted position the fins of said guide mechanism at the trailing end of said support means for the guide mechanism, said propellant cage extending over at least a part of said fins, the fins in the retracted condition thereof having leading edges sloped inwardly and outwardly at an acute angle relative to the longitudinal axis of the projectile, said propellant cage segments each having at their rear ends an internal surface sloping outwardly and rearwardly relative to the leading edges of said fins, and said fins in the region covered by the propellant cage include outer edges extending outwardly and rearwardly relative to the leading edges of the fins and being contiguous with the internal surfaces of the propellant cage segments so as to reach their greatest expanse towards the end of the guide mechanism.

2. Fin-stabilized projectile as claimed in claim 1, wherein the number of propellant cage segments is equal to the number of fins of the guide mechanism.

3. Fin-stabilized projectile as claimed in claim 1 wherein the number of the propellant cage segments and that of the guide mechanism fins is a multiple integer, such that at least one fin projects into respectively one said propellant cage segment.

* * * * *